US008248399B2

(12) United States Patent
Park et al.

(10) Patent No.: US 8,248,399 B2
(45) Date of Patent: Aug. 21, 2012

(54) DRIVING-VOLTAGE GENERATION APPARATUS AND LIQUID CRYSTAL DISPLAY HAVING THE SAME

(75) Inventors: Do-Hyeon Park, Cheonan-si (KR); Myoung-Ha Jeon, Cheonan-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 590 days.

(21) Appl. No.: 12/480,253

(22) Filed: Jun. 8, 2009

(65) Prior Publication Data

US 2009/0303403 A1 Dec. 10, 2009

(30) Foreign Application Priority Data

Jun. 9, 2008 (KR) ..... 10-2008-0053776

(51) Int. Cl.
*G09G 5/00* (2006.01)
*G05F 5/00* (2006.01)

(52) U.S. Cl. ..... 345/212; 323/299

(58) Field of Classification Search ..... 323/299; 345/212; 349/40

See application file for complete search history.

(56) References Cited

U.S. PATENT DOCUMENTS

2002/0105512 A1* 8/2002 Kwon ..... 345/212
2006/0279498 A1* 12/2006 Kaneda et al. ..... 345/89

* cited by examiner

*Primary Examiner* — Nathanael R Briggs
(74) *Attorney, Agent, or Firm* — F. Chau & Associates, LLC

(57) ABSTRACT

A driving-voltage generation apparatus and a liquid crystal display (LCD) having the same are provided. The driving-voltage generation apparatus includes an input node coupled to an input voltage, a voltage converter configured to convert the input voltage into an output voltage and output the output voltage, and a voltage cutoff unit electrically connected between the input node and the voltage converter. The voltage cutoff unit is configured to sense the input voltage and selectively cut off the supply of the input voltage.

20 Claims, 7 Drawing Sheets

DRIVING-VOLTAGE GENERATION APPARATUS AND LIQUID CRYSTAL DISPLAY HAVING THE SAME

CROSS-REFERENCE TO RELATED APPLICATION

This application claims priority to Korean Patent Application No. 10-2008-0053776, filed on Jun. 9, 2008 in the Korean Intellectual Property Office, the disclosure of which is incorporated by reference in its entirety herein.

BACKGROUND OF THE INVENTION

1. Technical Field

Embodiments of the present invention relate to a driving-voltage generation apparatus and a liquid crystal display (LCD) having the same.

2. Discussion of Related Art

Liquid crystal displays (LCDs) may include a first display panel having a plurality of pixel electrodes, a second display panel having a common electrode, a liquid crystal layer interposed between the first and second display panels and having dielectric anisotropy, a gate driver driving a plurality of gate lines, a data driver outputting a data signal, and a voltage generator generating a gate-on voltage, a gate-off voltage and a common voltage.

The voltage generator may include a gate on/off voltage generator generating the gate-on voltage and the gate-off voltage, a common voltage generator generating the common voltage and a driving voltage generator providing a driving voltage to the gate on/off voltage generator and the common voltage generator.

A fuse may be provided in the driving voltage generator to prevent excessive current from flowing into circuits in the driving voltage generator. A fuse has a rated current parameter. The parameter specifies the maximum current that the fuse can continuously pass without interruption or harmful effects on its surroundings. The fuse may open when this parameter is exceeded. If the fuse has a rated current that is lower than what is needed for a particular application, the fuse may open more often than desired. However, if the fuse has a rated current that is too high, excessive current may be generated in the driving voltage generator. The excessive current may cause an inductor in the driving voltage generator to deteriorate and fail or cause a fire in the driving voltage generator due to overheating.

Thus, there is a need for a driving voltage generator that is less susceptible to overheating and an LCD that employs the driving voltage generator.

SUMMARY OF THE INVENTION

An exemplary embodiment of the present invention includes a driving-voltage generation apparatus. The driving-voltage generation apparatus includes: an input node, a voltage converter, and a voltage cutoff unit. The input node is coupled to an input voltage. The voltage converter converts the input voltage into an output voltage and outputs the output voltage. The voltage cutoff unit is electrically connected between the input node and the voltage converter. The voltage cutoff unit is configured to sense the input voltage and selectively cut off a supply of the input voltage.

An exemplary embodiment of the present invention includes a driving-voltage generation apparatus. The driving-voltage generation apparatus includes: an input node, a voltage converter, and a voltage cutoff unit. The input node is coupled to an input voltage. The voltage converter converts the input voltage into an output voltage and outputs the output voltage. The voltage cutoff unit is electrically connected between the input node and the voltage converter. The voltage cutoff unit is configured to cut off a supply of the input voltage when an excessive current flows from the input node into the voltage converter.

An exemplary embodiment of the present invention includes an LCD. The LCD includes: a plurality of gate and data lines, a liquid crystal panel, a gate driver, a data driver, and a driving voltage generator. The liquid crystal panel includes a plurality of pixels. The pixels may be disposed at the intersections between the plurality of gate lines and the plurality of data lines. The gate driver is configured to apply a gate-on voltage and a gate-off voltage to the gate lines. The data driver is configured to apply a data voltage to the data lines. The driving voltage generator is configured to provide a driving voltage to the gate driver. The driving voltage generator includes an input node, a voltage converter, and a voltage cutoff unit. The input node is coupled to an input voltage. The voltage converter converts the input voltage into an output voltage and outputs the output voltage. The voltage cutoff unit is electrically connected between the input node and the voltage converter. The voltage cutoff unit is configured to sense the input voltage and selectively cut off a supply of the input voltage.

BRIEF DESCRIPTION OF THE DRAWINGS

The present invention will become more apparent by describing in detail exemplary embodiments thereof with reference to the attached drawings, in which.

DETAILED DESCRIPTION OF EXEMPLARY EMBODIMENTS

The present invention will now be described more fully with reference to the accompanying drawings, in which exemplary embodiments of the invention are shown. The invention may, however, be embodied in many different forms and should not be construed as being limited to the embodiments set forth herein. It will be understood that when an element is referred to as being "connected" or "coupled" to another element, it can be directly connected or coupled to the other element or intervening elements may be present. Like numbers may refer to like elements throughout.

A driving-voltage generation apparatus according to an exemplary embodiment of the present invention will hereinafter be described in detail with reference to FIGS. 1 through 3.

Figure 1:
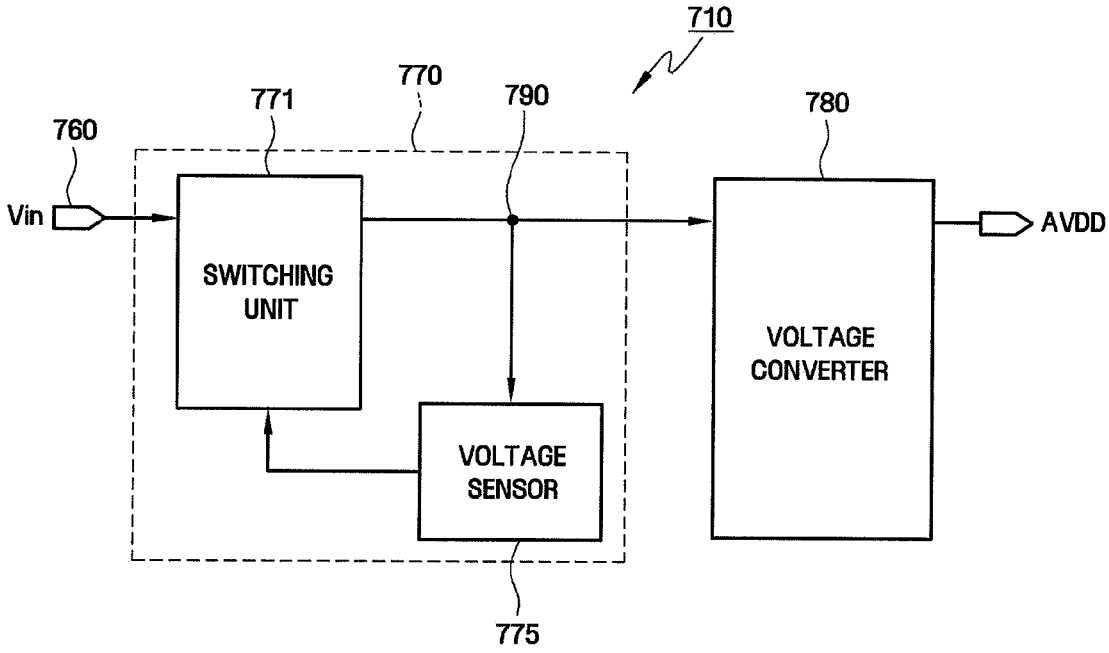
FIG. 1 illustrates a block diagram of a driving-voltage generation apparatus according to an exemplary embodiment of the present invention.
Figure 2:
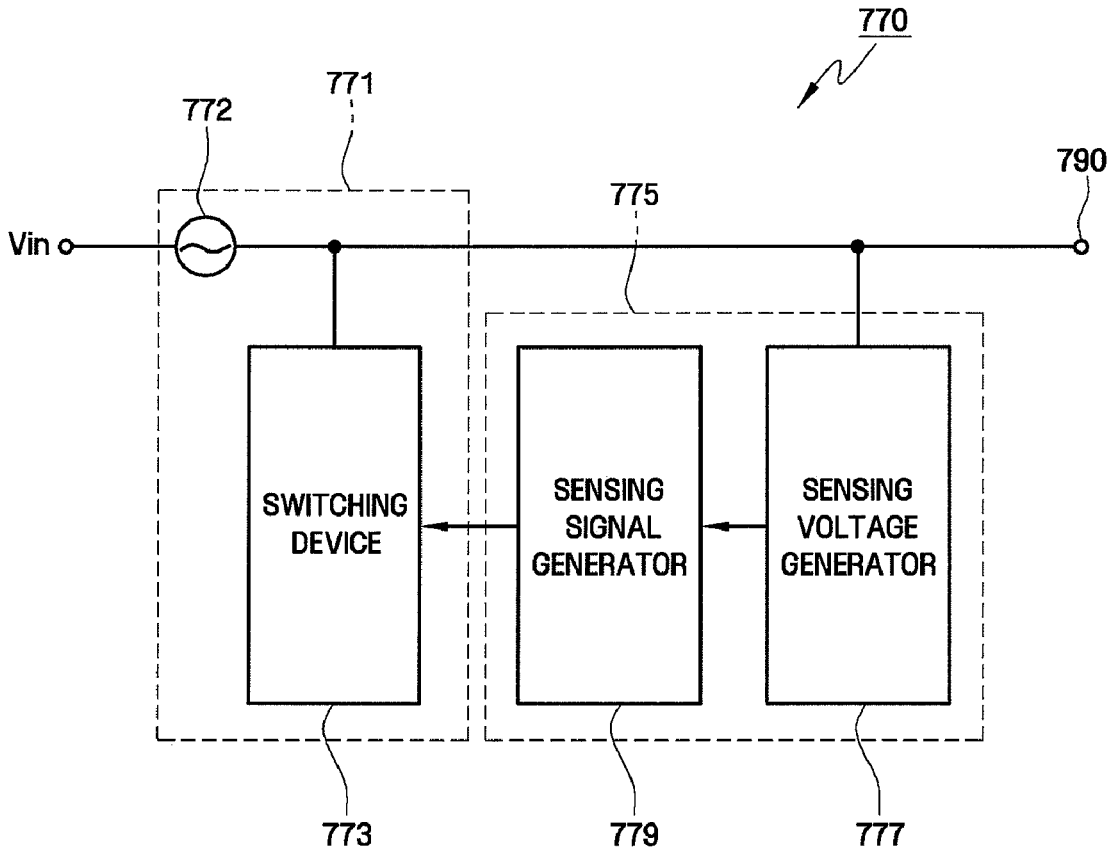
FIG. 2 illustrates a block diagram of an exemplary embodiment of a voltage cutoff unit shown in FIG. 1.
Figure 3:
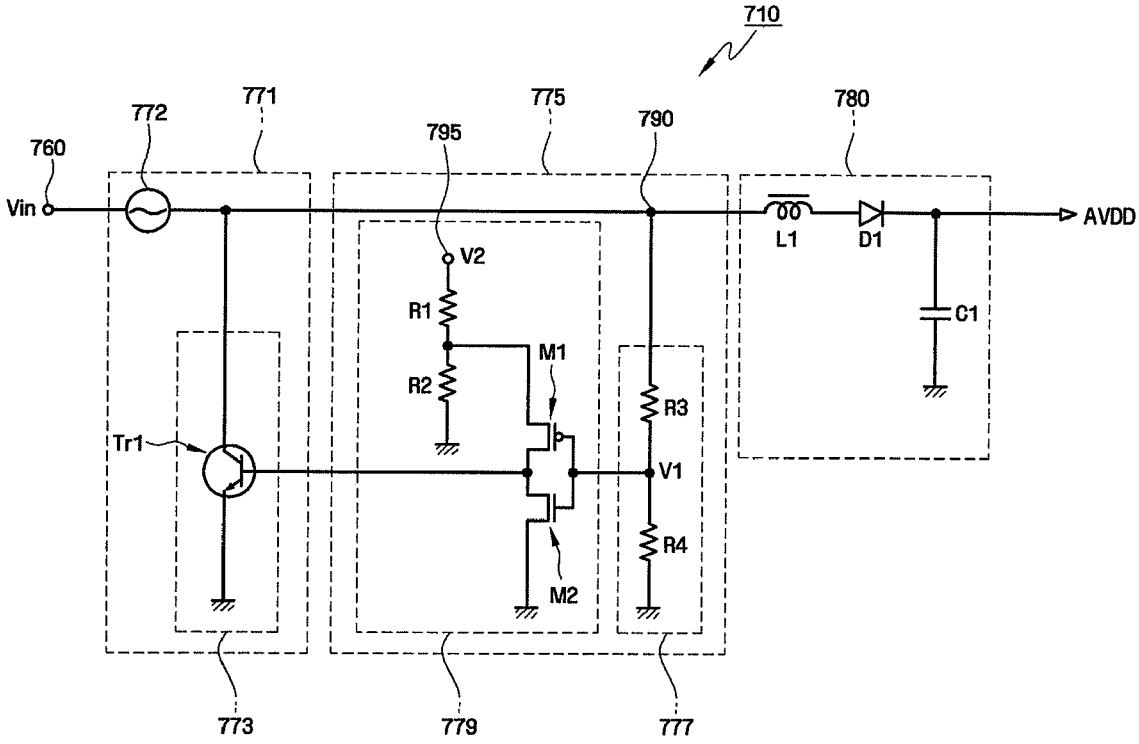
FIG. 3 illustrates a circuit diagram of the driving-voltage generation apparatus shown in FIG. 1 according to an exemplary embodiment of the present invention.

FIG. 1 illustrates a block diagram of a driving-voltage generation apparatus 710 according to an exemplary embodiment of the present invention, FIG. 2 illustrates a block diagram of an exemplary embodiment of a voltage cutoff unit 770 shown in FIG. 1, and FIG. 3 illustrates a circuit diagram of the driving-voltage generation apparatus 710.

Referring to FIG. 1, the driving-voltage generation apparatus 710 may include an input node 760, the voltage cutoff unit 770 and a voltage converter 780. When an input voltage Vin is coupled to the input node 760, the voltage converter 780 converts the input voltage Vin into an output voltage and outputs the output voltage. The output voltage may be a driving voltage AVDD. The driving voltage AVDD may be input to a voltage generator (not shown), and the voltage generator may generate a gate-on voltage Von, a gate-off voltage Voff and a common voltage Vcom.

The voltage cutoff unit 770 may be electrically connected and disposed between the input node 760 and the voltage converter 780. The voltage cutoff unit 770 senses the input voltage Vin and may selectively cut off the supply of the input voltage Vin when certain conditions are satisfied. For example, the voltage cutoff unit 770 may cut off the supply when it determines that the input voltage Vin has changed or when it determines that an excessive current is flowing or about to flow into the voltage converter 780.

The voltage cutoff unit 770 may include a voltage sensor 775 and a switching unit 771. The voltage sensor 775 senses the level of the input voltage Vin. The switching unit 771 can selectively cut off the supply of the input voltage Vin to the voltage converter 780 in response to a sensing signal output by the voltage sensor 775.

The voltage cutoff unit 770 will hereinafter be described in further detail with reference to FIG. 2. Referring to FIG. 2, the voltage cutoff unit 770 may include the voltage sensor 775 and the switching unit 771. The voltage sensor 775 may include a sensing voltage generator 777 and a sensing signal generator 779.

The sensing voltage generator 777 may generate a sensing voltage based on the input voltage Vin. The sensing signal generator 779 may generate a sensing signal corresponding to the sensing voltage.

The switching unit 771 may include a fuse 772 and a switching device 773. The fuse 772 may be connected between the input node 760 and a first node 790, and the switching device 773 may be coupled between the first node 790 and a ground.

The fuse 772 may have a rated voltage and a rated current. When the switching device 773 is turned on and an excessive current higher than a predefined level flows through the fuse 772, the fuse 772 may melt and become blown due to corresponding heat generated in the fuse 772. For example, if the driving-voltage generation apparatus 710 is used in a liquid crystal display (LCD), the fuse 772 may have a rated current of about 3.0 A.

The switching device 773 is coupled between the first node 790 and the ground and may be selectively turned on or off in response to a sensing signal. The switching device 773 may turn on or off according to a voltage level of the input voltage Vin, thereby enabling the supply of the input voltage Vin to be selectively cut off.

When the input voltage Vin is applied normally, the sensing voltage generator 777 may generate a first sensing voltage and output the first sensing voltage to the sensing signal generator 779. The sensing signal generator 779 may generate a first sensing signal in response to the first sensing voltage and transmit the first sensing signal to the switching unit 771. The first sensing signal can maintain the switching device 773 to be turned off.

When the input voltage Vin is applied abnormally (e.g., when an excessive current flows into the voltage converter 780), the sensing voltage generator 777 may generate a second sensing voltage and output the second sensing voltage to the sensing signal generator 779. The sensing signal generator 779 may generate a second sensing signal in response to the second sensing voltage and transmit the second sensing signal to the switching unit 771. The second sensing signal may indicate that the input voltage Vin has been applied abnormally. The switching device 773 may be turned on in response to the second sensing signal. As a result, the fuse 772 may open due to heat generated by an excessive current applied thereto, and thus, the supply of the input voltage Vin to the voltage converter 780 may be cut off.

Referring to FIG. 3, the voltage converter 780 may be a direct current-direct current (DC-DC) converter (e.g., a boost converter). The voltage converter 780 may include an inductor L1, a diode D1, and a capacitor C1. The input voltage Vin may be applied to the inductor L1. The anode of the diode D1 may be connected to the inductor L1, and the cathode of the diode D1 may be connected to a driving voltage output terminal, from which the driving voltage AVDD is output. The capacitor C1 may be connected between the cathode of the diode D1 and the ground for output of the driving voltage AVDD.

The voltage converter 780 may also include a switching device (not shown) connected between the diode D1 and the ground. The switching device may output the driving voltage AVDD. The driving voltage AVDD may be obtained by boosting the input voltage Vin to a desired level, while being repeatedly turned on or off in response to a control signal such as a pulse width modulation (PWM) signal having a predetermined duty ratio. For example, the input voltage Vin may be about 5 V, and the driving voltage AVDD may be about 17.5 V. The voltage converter 780 is not limited to the embodiment illustrated in FIG. 3.

The voltage cutoff unit 770 may include the switching unit 771 and the voltage sensor 775. The voltage sensor 775 may include the sensing voltage generator 777 and the sensing signal generator 779.

The sensing voltage generator 777 may include voltage-dividing resistors R3 and R4 electrically connected and disposed between the first node 790 and the ground. The input voltage Vin applied to the first node 790 may be divided by the voltage-dividing resistors R3 and R4, thereby generating a sensing voltage V1.

The sensing signal generator 779 may include a complementary metal oxide semiconductor (CMOS) inverter. The input terminal of the CMOS inverter may be connected to a node to which the input voltage Vin is applied, and the output terminal of the CMOS inverter may be connected to the switching device 773 of the switching unit 771. The CMOS inverter may be driven by a second voltage V2, which may be coupled to a second node 795. The second voltage V2 may be applied to the CMOS inverter after being divided by voltage-dividing resistors R1 and R2 electrically connected or disposed between the second node 795 and the ground. In this example, the second voltage V2 may be the gate-on voltage Von.

The switching unit 771 may include the fuse 772 and the switching device 773. The switching device 773 may be a transistor Tr1. The base of the transistor Tr1 may be connected to the output terminal of the sensing signal generator 779, the emitter of the transistor Tr1 may be connected to the ground, and the collector of the transistor Tr1 may be connected to the first node 790. The type of the switching device 773 and how the switching device 773 is connected to other elements may be altered in various manners as long as the switching device 773 can open or close the electric connection between the first node 790 and the ground.

The operating principles of the voltage cutoff unit 770 will hereinafter be described in detail, with a focus on an example where the voltage converter 780 operates abnormally.

The sensing voltage generator 777 generates the sensing voltage V1 based on the input voltage Vin, which may be applied from the first node 790 to the voltage converter 780. The sensing voltage generator 777 transmits the sensing voltage V1 to the sensing signal generator 779. Since the input voltage Vin varies according to whether the voltage converter 780 operates normally, a variation, if any, in the input voltage Vin, can be determined based on the sensing voltage V1.

When the voltage converter 780 operates abnormally, for example, when any one of the elements following the inductor L1 (e.g., the capacitor C1) is short-circuited, an excessive current may flow into the voltage converter 780. The input voltage Vin may be reduced by a feedback circuit (not shown) to compensate for a decrease in the impedance of the voltage converter 780 and the excessive current. Since the sensing voltage V1 may be obtained by dividing the input voltage Vin, a drop in the input voltage Vin may cause the sensing voltage V1 to decrease. Accordingly, a reduced sensing voltage V1 may be transmitted to the sensing signal generator 779.

The sensing signal generator 779 may generate a sensing signal corresponding to the reduced sensing voltage V1 provided by the sensing voltage generator 777 and may transmit the sensing signal to the switching unit 771.

When the reduced sensing voltage V1 is received due to the voltage converter 780 operating abnormally, the sensing signal generator 779 may transmit a divided voltage (e.g., obtained by dividing the second voltage V2) to the switching unit 771. For example, when the reduced sensing voltage V1 is applied to the input terminal of the CMOS inverter in the sensing signal generator 779, a P-channel metal oxide semiconductor (PMOS) M1 may be turned on, and an N-type metal oxide semiconductor (NMOS) M2 may be turned off. Accordingly, the divided voltage of the second voltage V2 may be transmitted to the switching unit 771. When the voltage converter 780 operates normally, the present voltage level of the sensing voltage V1 may be maintained. Thus, the PMOS M1 may be turned off, and the NMOS M2 may be turned on. Accordingly, a ground voltage may be transmitted to the switching unit 771.

The sensing signal generator 779 may transmit the divided voltage of the second voltage V2 to the switching unit 771 as a sensing signal when the voltage converter 780 operates abnormally, and may transmit a ground voltage to the switching unit 771 as a sensing signal when the voltage converter 780 operates normally. A sensing signal provided by the sensing signal generator 779 may be an analog signal having a uniform voltage or a digital signal having a first level or a second level. The first level may be one of a high level or a low level, and the second level may be one of the high level or the low level that is not the first level. For example, one of the first and second levels may turn on the switching device 773 of the switching unit 771.

The switching unit 771 may selectively cut off the supply of the input voltage Vin in response to the sensing signal provided by the sensing signal generator 779. For example, the sensing signal provided by the sensing signal generator 779 may be input to the switching device 773, which may be electrically connected or disposed between the first node 790 and the ground. The sensing signal may determine whether to turn on or off the switching device 773. When the switching device 773 is the transistor Tr1, the sensing signal provided by the sensing signal generator 779 may be input to the base of the transistor Tr1. When the voltage converter 780 operates abnormally, the divided voltage of the second voltage V2 or a digital signal having the first level may be input to the switching device 773 as a sensing signal, and thus, the switching device 773 may be turned on.

The state of the voltage cutoff unit 770 before the switching device 773 is turned on during a abnormal operation of the voltage converter 780 will hereinafter be described in detail. When any one of the elements following the inductor L1 of the voltage converter 780 is short-circuited, the total impedance of the voltage converter 780 may decrease, and thus, a current that flows into the voltage converter 780 may increase. However, the inductor L1 may block part of the current from flowing into the voltage converter 780, and thus, excessive current may be prevented from flowing into the fuse 772 until the switching device 773 is turned on. If the inductor L1 continues to block the current, the inductor L1 may deteriorate or a fire may take place in the inductor L1.

However, if the voltage sensor 775 detects a decrease in the input voltage Vin, caused by excessive current flowing into the voltage converter 780, and transmits a sensing signal to the switching unit 771, the switching device 773 may be turned on, and the fuse 772 may be opened. Accordingly, an excessive current may be prevented from flowing into the inductor L1 of the voltage converter 780. Thus, the deterioration of the inductor L1 or the occurrence of a fire in the inductor L1 may be prevented.

In the exemplary embodiment of FIGS. 1 through 3, an input voltage applied to a voltage converter may be detected. When an excessive current flows into the voltage converter, a switching device connected to a fuse and a ground may be turned off, and thus, the fuse may be opened. Accordingly, the deterioration of a circuit or the occurrence of a fire due to an excessive current may be prevented.

Figure 4:
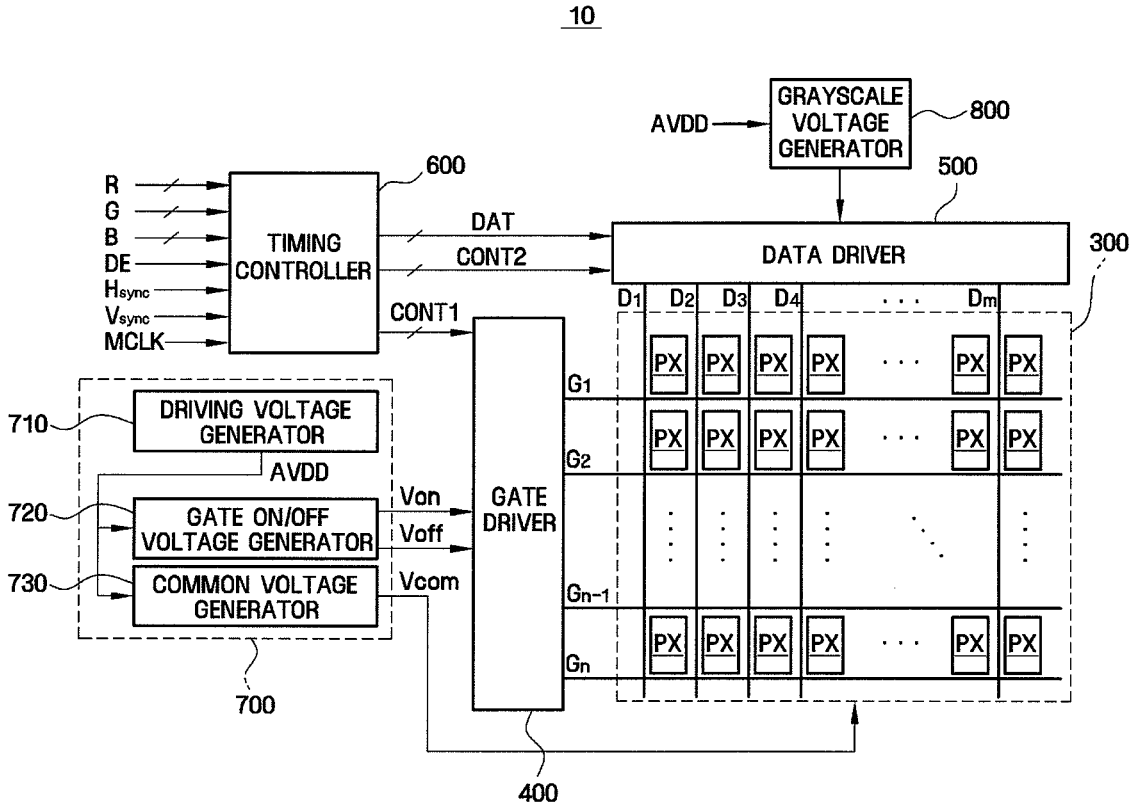
FIG. 4 illustrates a block diagram of a liquid crystal display (LCD) having the driving-voltage generation apparatus shown in FIG. 1.
Figure 5:
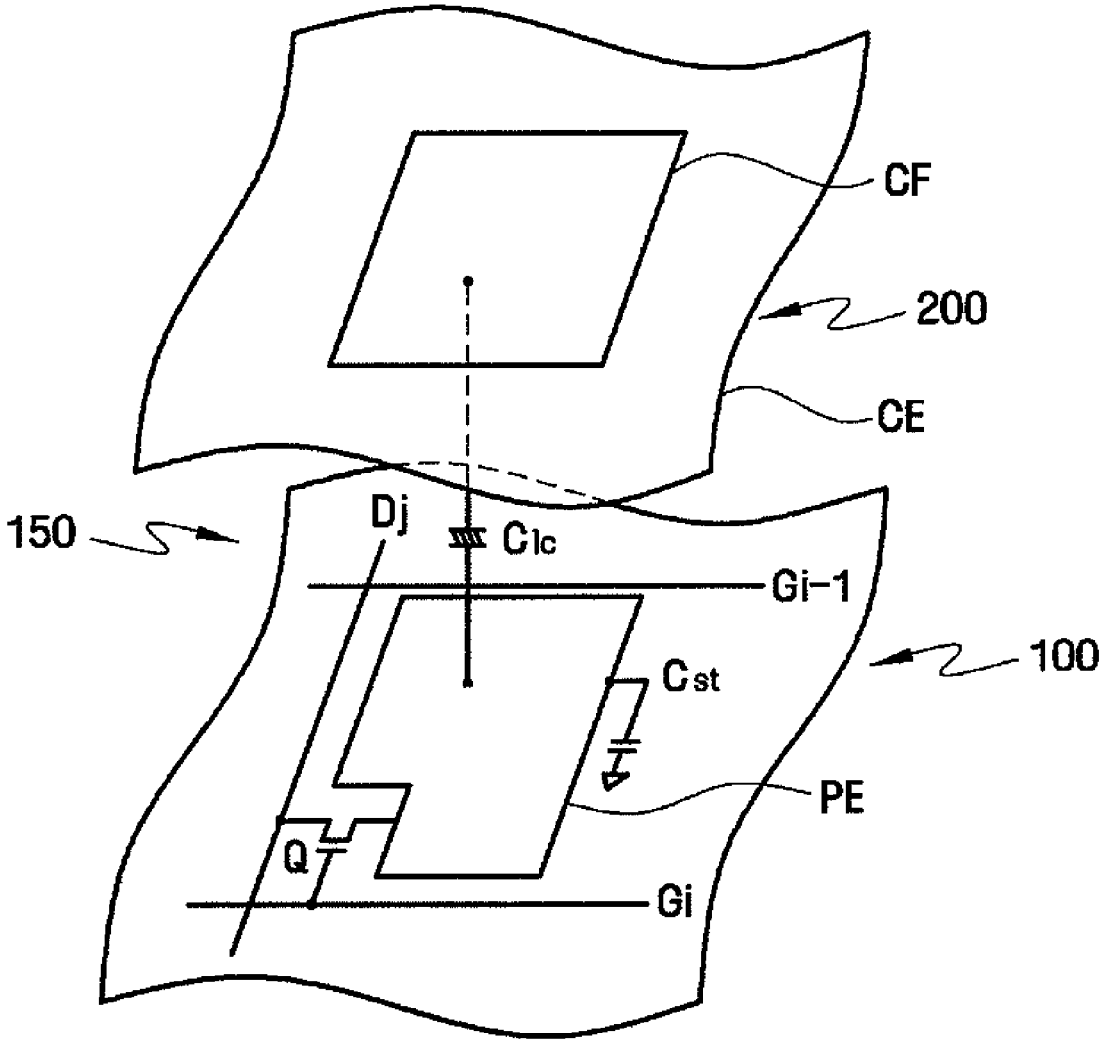
FIG. 5 illustrates an equivalent circuit diagram of a pixel of the LCD shown in FIG. 4.

An LCD having the driving-voltage generation apparatus 710 will hereinafter be described in detail with reference to FIGS. 4 and 5 according to an exemplary embodiment of the present invention. FIG. 4 illustrates a block diagram of an LCD 10 having the driving-voltage generation apparatus 710, and FIG. 5 illustrates an equivalent circuit diagram of a pixel of the LCD 10.

Referring to FIG. 4, the LCD 10 includes a liquid crystal panel 300, a gate driver 400 and a data driver 500, which are connected to the liquid crystal panel 300, a gray voltage generator 800, which is connected to the data driver 500, a timing controller 600, which controls the gate driver 400, the data driver 500, and the grayscale voltage generator 800, and a voltage generator 700.

The liquid crystal panel 300 includes a plurality of pixels PX, which are connected to a plurality of display signal lines and may be arranged in a matrix. The display signal lines include a plurality of gate lines $G_l$ through $G_n$, which transmit a gate signal, and a plurality of data lines $D_l$ through $D_m$, which transmit a data signal. The gate lines $G_l$ through $G_n$ may extend in a column direction in parallel with one another. The data lines $D_l$ through $D_m$ may extend in a row direction in parallel with one another.

The gate driver 400 may be provided with a gate control signal CONT1 by the timing controller 600. The gate driver may sequentially output a gate-on voltage Von and a gate-off voltage Voff to the gate lines $G_l$ through $G_n$ in response to the gate control signal CONT1. The gate-on voltage Von and the gate-off voltage Voff may be provided by the voltage generator 700.

The data driver 500 may be provided with a data control signal CONT2 and image data DAT by the timing controller 600, may choose a gray voltage corresponding to the image data DAT, and may provide the chosen gray voltage to the data lines $D_1$ through $D_m$.

The gate control signal CONT1 may be a signal for controlling the operation of the gate driver 400. Examples of the gate control signal CONT1 may include a vertical initiation signal STV for initiating the operation of the gate driver 400, a gate clock signal CPV for determining when to output the gate-on voltage Von, and an output enable signal OE for determining the pulse width of the gate-on voltage Von. The data control signal CONT2 may be a signal for controlling the operation of the data driver 500. Examples of the data control signal CONT2 may include a horizontal initiation signal STH for initiating the operation of the data driver 500 and an output instruction signal TP for providing instructions to output a data voltage.

The grayscale voltage generator 800 may include a plurality of resistors (not shown), which may be connected in series between a ground and a node to which a driving voltage AVDD is applied, and may thus generate a plurality of gray voltages by dividing the driving voltage AVDD. However, the gray voltage generator 800 is not limited to a plurality of resistors. For example, the grayscale voltage generator 800 may be realized in various manners, other than those set forth herein.

The timing controller 600 may receive a red (R)-green (G)-blue (B) signal and a plurality of external clock signals for controlling the display of the RGB signal from an external graphic controller (not shown). The external clock signals may include a data enable signal DE, a vertical synchronization signal $V_{sync}$, a horizontal synchronization signal $H_{sync}$, and a main clock signal MCLK. The data enable signal DE may maintain the RGB signal to have a high level during the input of the RGB signal to the timing controller 600, and thus may enable the timing controller 600 to identify the RGB signal. The vertical synchronization signal $V_{sync}$ may be a signal for indicating the beginning of a frame. The horizontal synchronization signal $H_{sync}$ may be a signal for distinguishing the gate lines $G_1$ through $G_n$. The main clock signal MCLK may be a clock signal with which signals for driving the LCD 10 may be synchronized.

The timing controller 600 may receive the RGB signal, may generate the image data DAT based on the RGB signal, and may provide the image data DAT to the data driver 500. In addition, the timing controller 600 may generate internal clock signals (e.g., the gate control signal CONT1 and the data control signal CONT2) based on the external clock signals (e.g., the $V_{sync}$, $H_{sync}$, MCLK, and DE signals).

Each of the pixels PX of the liquid crystal panel 300 may include a liquid crystal capacitor $C_{lc}$ and a storage capacitor $C_{st}$, as shown in FIG. 5. Referring to FIG. 5, the liquid crystal capacitor $C_{lc}$ may include a pixel electrode PE, which may be formed on the first display panel 100, a common electrode CE, which may be formed on the second display panel 200, and a liquid crystal layer 150, which may be interposed between the first and second display panels 100 and 200. A color filter CF may be formed on the second display panel 200 and may account for part of the second display panel 200. A switching device Q may be connected to an i-th gate line $G_i$ (where i may range between 1 and n) and a j-th data line $D_j$ (where j may range between 1 and m) and may provide a data voltage to the liquid crystal capacitor $C_{lc}$. The storage capacitor $C_{st}$ may be optional.

A common voltage Vcom, which may be provided by a common voltage generator (not shown), may be applied to the common electrode CE. A data voltage, which may be provided by the data driver 500, may be applied to the pixel electrode PE through the j-th data line $D_j$. The liquid crystal capacitor $C_{lc}$ may be charged with a voltage corresponding to the difference between the common voltage and the data voltage and may thus display an image.

The voltage generator 700 may include a driving voltage generator 710, a gate on/off voltage generator 720, and a common voltage generator 730. The driving voltage generator 710 may generate a voltage for driving the LCD 10. For example, the driving voltage generator 710 may generate the driving voltage AVDD. The driving voltage AVDD may be a basic gray voltage for generating a plurality of gray voltages. The driving voltage generator 710 may provide the driving voltage AVDD to the grayscale voltage generator 800, the gate on/off voltage generator and the common voltage generator 730.

The driving voltage generator 710 may include or may be substantially the same as the driving-voltage generation apparatus 710 of the exemplary embodiment of FIGS. 1 through 3. For example, the driving voltage generator 710 may include an input node coupled to an input voltage, a voltage converter (not shown) converting the input voltage into an output voltage and outputting the output voltage, and a voltage cutoff unit (not shown) disposed between the input node and the voltage converter, detecting the input voltage and selectively cutting off the supply of the input voltage.

The grayscale voltage generator 800 may be provided with the driving voltage AVDD by the driving voltage generator 710 and may generate a gray voltage. The grayscale voltage generator 800 may include a plurality of resistors (not shown), which may be connected in series between a ground and a node to which a driving voltage AVDD is applied, and may thus generate a gray voltage by dividing the driving voltage AVDD. However, the grayscale voltage generator is not limited to including a plurality of resistors. For example, the grayscale voltage generator 800 may be realized in various manners, other than those set forth herein.

Figure 6:
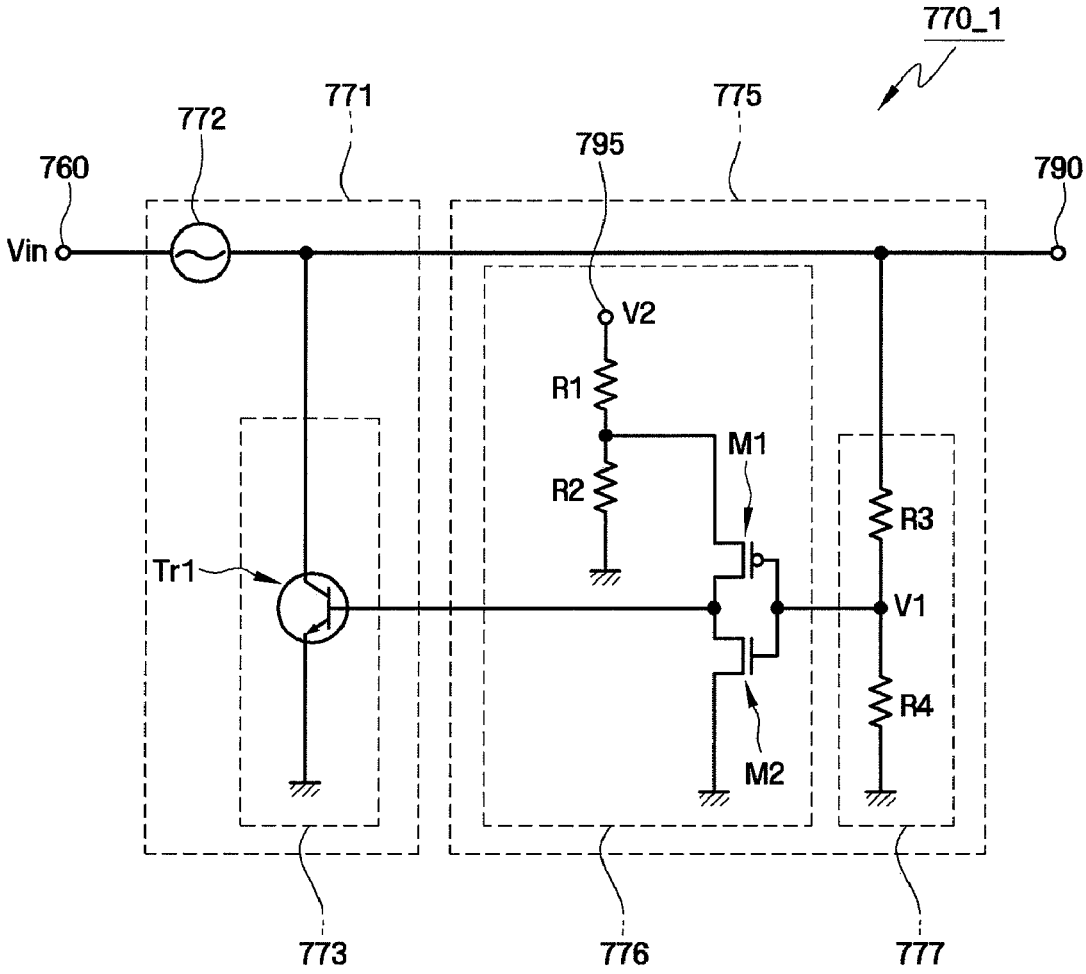
FIG. 6 illustrates a circuit diagram of a voltage cutoff unit of a driving-voltage generation apparatus according to another exemplary embodiment of the present invention.

A driving-voltage generation apparatus and an LCD having the driving-voltage generation apparatus according to other exemplary embodiments of the present invention will hereinafter be described in detail with reference to FIGS. 6 and 7. FIG. 6 illustrates a circuit diagram of a voltage cutoff unit 770_1 of a driving-voltage generation apparatus according to another exemplary embodiment of the present invention, and FIG. 7 illustrates a block diagram of an LCD 11 having the driving-voltage generation apparatus of the exemplary embodiment of FIG. 6.

Figure 7:
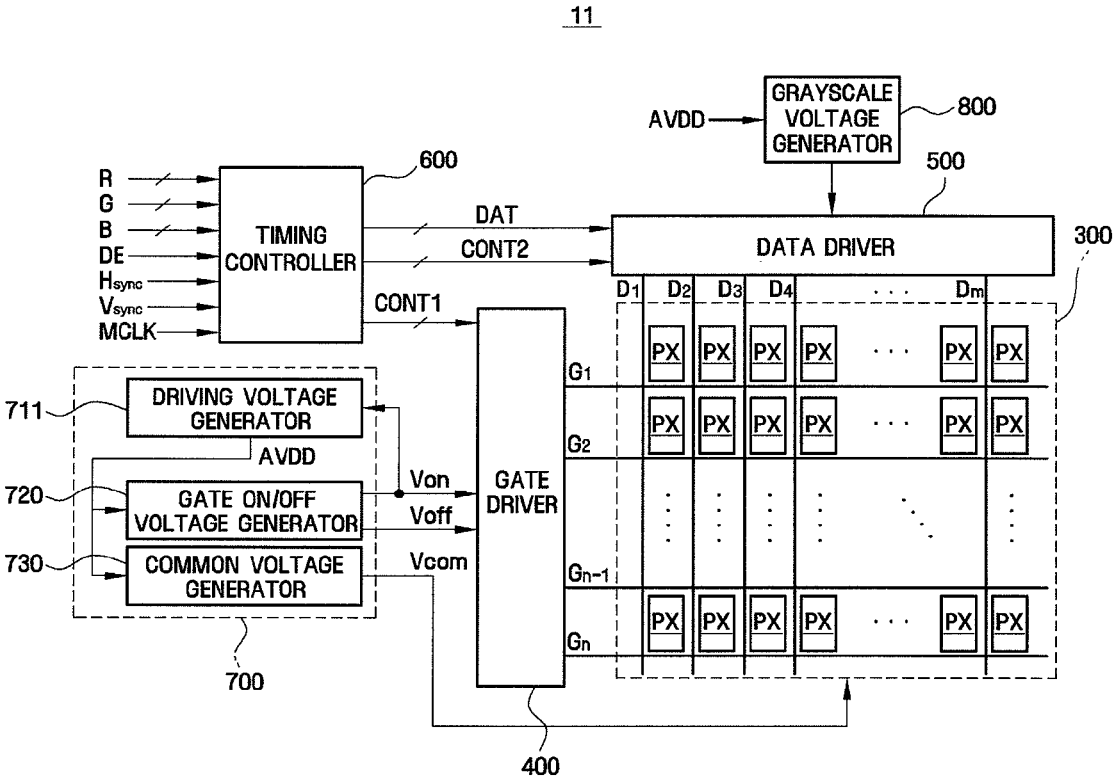
FIG. 7 illustrates a block diagram of an LCD having the driving-voltage generation apparatus of the exemplary embodiment of FIG. 6.

The exemplary embodiments of FIGS. 6 and 7 differ from the exemplary embodiments of FIGS. 1 through 5 in that a gate-on voltage Von may be coupled to a second node 795 for driving a CMOS inverter. In FIGS. 1 through 7, like reference numerals may indicate like elements, and thus, detailed descriptions thereof will be omitted.

Referring to FIGS. 6 and 7, the voltage cutoff unit 770_1 may apply the gate-on voltage Von to the second node 795. The gate-on voltage Von may be generated based on a driving voltage AVDD by a gate on/off voltage generator 720. When the gate-on voltage Von is applied to a gate driver 400, a plurality of gate lines $G_1$ through $G_n$ of a liquid crystal panel 300 may be sequentially turned on. The gate-on voltage Von may range from about 20 V to about 30 V. The gate-on voltage Von may vary according to the purpose of use.

The time elapsed for the gate-on voltage Von to be discharged from the liquid crystal panel 300 may range from about 30 ms to about 1 s. When the gate-on voltage Von is applied to the second node 795, a second voltage V2 may be continuously maintained to be as high as the gate-on voltage Von for a predetermined amount of time even when the supply of an input voltage Vin is cut off. For example, even if the supply of the input voltage Vin is cut off, the second voltage V2 may maintain a switching device 773 to be turned on due to the gate-on voltage Von.

While the present invention has been particularly shown and described with reference to exemplary embodiments thereof, it will be understood by those of ordinary skill in the art that various changes in form and details may be made therein without departing from the spirit and scope of the disclosure.

What is claimed is:

1. A driving-voltage generation apparatus comprising:
an input node coupled to an input voltage;
a voltage converter configured to convert the input voltage into an output voltage and output the output voltage; and
a voltage cutoff unit electrically connected between the input node and the voltage converter,
wherein the voltage cutoff unit comprises:
a voltage sensor sensing a voltage level of the input voltage and outputting a sensing signal based on the sensed voltage level; and
a switching unit comprising a transistor connected between the input node and a ground, a control terminal of the transistor receiving the sensing signal.

2. The driving-voltage generation apparatus of claim 1, wherein the voltage sensor comprises a sensing voltage generator generating a sensing voltage based on the input voltage and a sensing signal generator generating the sensing signal corresponding to the sensing voltage.

3. The driving-voltage generation apparatus of claim 2, wherein the sensing signal generator is driven by a gate-on voltage.

4. The driving-voltage generation apparatus of claim 1, wherein the switching unit comprises:
a fuse coupled between the input node and an input terminal of the transistor, wherein the fuse is coupled to the voltage converter and
wherein the transistor is selectively turned on in response to the sensing signal.

5. The driving-voltage generation apparatus of claim 4, wherein:
when the sensing signal is set to a first level, the transistor is turned on and the fuse is opened; and
when the sensing signal is set to a second level, which is different from the first level, the transistor is turned off.

6. The driving-voltage generation apparatus of claim 5, wherein the sensing signal is set to the first level when an excessive current flows into the voltage converter.

7. The driving-voltage generation apparatus of claim 1, wherein the voltage sensor comprises a complementary metal-oxide semiconductor (CMOS) inverter.

8. The driving-voltage generation apparatus of claim 1, wherein the voltage converter comprises:
an inductor and a diode coupled in series between a first node, which is coupled to the voltage cutoff unit;
an output node, wherein the output node is coupled to the output voltage; and
a capacitor coupled between the output node and a ground.

9. The driving-voltage generation apparatus of claim 8, wherein the voltage cutoff unit is configured to sense the voltage of the first node and cut off the supply of the input voltage when the capacitor is short circuited.

10. The driving-voltage generation apparatus of claim 1, wherein the output voltage is input to a plurality of voltage generators, which respectively generate a gate-on voltage, a gate-off voltage and a common voltage.

11. A driving-voltage generation apparatus comprising:
an input node coupled to an input voltage;
a voltage converter configured to convert the input voltage into an output voltage and output the output voltage; and
a voltage cutoff unit electrically connected between the input node and the voltage converter and configured to cut off a supply of the input voltage when an excessive current flows from the input node into the voltage converter,
wherein the voltage cutoff unit comprises a switching unit, and the switching unit comprises a fuse coupled between the input node and the voltage converter.

12. The driving-voltage generation apparatus of claim 11, wherein:
the voltage cutoff unit comprises a voltage sensor configured to sense the input voltage and output a sensing signal,
wherein the switching unit is configured to operate in response to the sensing signal,
wherein the fuse is coupled between the input node and a first node,
wherein the voltage cutoff unit further comprises a switching device coupled between the first node and a ground, and
wherein the switching device is configured to be selectively turned on in response to the sensing signal.

13. The driving-voltage generation apparatus of claim 12, wherein:
when the sensing signal is set to a first level, the switching device is turned on and the fuse is opened; and
when the sensing signal is set to a second level, which is different from the first level, the switching device is turned off.

14. The driving-voltage generation apparatus of claim 11, wherein the voltage sensor comprises a sensing voltage generator configured to generate a sensing voltage based on the input voltage and a sensing signal generator configured to generate a sensing signal corresponding to the sensing voltage.

15. The driving-voltage generation apparatus of claim 14, wherein the sensing signal generator is driven by a gate-on voltage.

16. A liquid crystal display (LCD) comprising:
a plurality of gate lines and data lines;
a liquid crystal panel comprising a plurality of pixels; a gate driver configured to applying a gate-on voltage and a gate-off voltage to the gate lines;
a data driver applying a data voltage to the data lines; and
a driving voltage generator configured to provide a driving voltage to the gate driver,
wherein the driving voltage generator comprises:
an input node coupled to an input voltage;
a voltage converter configured to convert the input voltage into an output voltage and output the output voltage; and
a voltage cutoff unit disposed between the input node and the voltage converter,
wherein the voltage cutoff unit comprises:

a voltage sensor sensing a voltage level of the input voltage and outputting a sensing signal based on the sensed voltage level; and a switching unit comprising a transistor connected between the input node and a ground, a control terminal of the transistor receiving the sensing signal.

17. The LCD of claim 16, wherein:

the switching unit further comprises a fuse coupled between the input node and a first node, wherein the fuse is coupled to the voltage converter, and the transistor is selectively turned on in response to the sensing signal.

18. The LCD of claim 17, wherein:

when the sensing signal is set to a first level, the transistor is turned on and the fuse is opened; and when the sensing signal is set to a second level, which is different from the first level, the transistor is turned off.

19. The LCD of claim 17, wherein the voltage sensor comprises a sensing voltage generator configured to generate a sensing voltage based on the input voltage and a sensing signal generator configured to generate the sensing signal corresponding to the sensing voltage.

20. The driving-voltage generation apparatus of claim 11, wherein the fuse is configured to melt and become blown when a switching circuit connected to the first node and a ground terminal is turned on and a current higher than a predefined level flows through the fuse.

* * * * *